US011654531B2

(12) United States Patent
Couch et al.

(10) Patent No.: US 11,654,531 B2
(45) Date of Patent: May 23, 2023

(54) SYSTEM FOR REDUCTION OF DIMENSIONAL END-TAPER IN ABRASIVE BLASTED TUBES

(71) Applicant: SANDVIK SPECIAL METALS LLC, Kennewick, WA (US)

(72) Inventors: Lynn Couch, Kennewick, WA (US); Kay Bowles, Richland, WA (US)

(73) Assignee: Sandvik Special Metals LLC, Kennewick, WA (US)

( * ) Notice: Subject to any disclaimer, the term of this patent is extended or adjusted under 35 U.S.C. 154(b) by 1063 days.

(21) Appl. No.: 16/344,151

(22) PCT Filed: Oct. 19, 2017

(86) PCT No.: PCT/US2017/057293

§ 371 (c)(1),
(2) Date: Apr. 23, 2019

(87) PCT Pub. No.: WO2018/080881

PCT Pub. Date: May 3, 2018

(65) Prior Publication Data

US 2019/0329379 A1 Oct. 31, 2019

Related U.S. Application Data

(60) Provisional application No. 62/412,409, filed on Oct. 25, 2016.

(51) Int. Cl.
*B24C 5/04* (2006.01)
*B24C 3/16* (2006.01)
(Continued)

(52) U.S. Cl.
CPC ..... *B24C 3/327* (2013.01); *B24C 3/16* (2013.01); *B24C 3/32* (2013.01); *B24B 31/116* (2013.01);
(Continued)

(58) Field of Classification Search
CPC .... B24C 1/10; B24C 3/06; B24C 3/16; B24C 3/32; B24C 3/325; B24C 3/327; B24C 5/04; B24C 7/0061
(Continued)

(56) References Cited

U.S. PATENT DOCUMENTS 4,417,421 A * 11/1983 Akagi ..... B24C 3/327 451/103
5,290,364 A 3/1994 Stein et al.
11,364,587 B2 * 6/2022 Thayer ..... B24B 31/006

FOREIGN PATENT DOCUMENTS

EP 1787753 A1 5/2007
WO 2004/078373 A1 9/2004
(Continued)

OTHER PUBLICATIONS

International Search Report and Written Opinion dated Jan. 31, 2018, issued in corresponding International Patent Application No. PCT/US2017/057293.

*Primary Examiner* — Eileen P Morgan
(74) *Attorney, Agent, or Firm* — Morgan, Lewis & Bockius LLP

(57) ABSTRACT

System for reduction of dimensional end-taper in abrasive blasted tubes has a pressurized chamber maintaining higher air pressure inside the chamber than atmospheric pressure, an air-exit port allowing gases to exit the chamber at a controlled rate, a valve restricting passage of gases from the air-exit port, a pressurized membrane through which the tube passes creating a seal, a gauge port where pressure inside the pressurized chamber is monitored and a media-exit port allowing evacuation of abrasive blast media particles after being expelled from the exit-end of the tube. The system addresses dimensional end-taper as high back pressure at the exit end of the tube reduces velocity of the gases and abrasive particles carried in it, thereby reducing erosion
(Continued)

of the inner walls of the tube near its exit end. The system can be employed with a wide range of tube sizes and in combination with several abrasive blasting techniques.

21 Claims, 5 Drawing Sheets

(51) Int. Cl.
*B24C 3/32* (2006.01)
*B24B 31/116* (2006.01)
*B24C 1/10* (2006.01)
*B24C 7/00* (2006.01)

(52) U.S. Cl.
CPC ..... *B24C 1/10* (2013.01); *B24C 5/04* (2013.01); *B24C 7/0061* (2013.01)

(58) Field of Classification Search
USPC ..... 451/11, 15, 38, 39, 40, 76, 87, 89
See application file for complete search history.

(56) References Cited

FOREIGN PATENT DOCUMENTS

WO 2008/029039 A2 3/2008
WO WO-2012156657 A1 * 11/2012 ..... B24C 5/02

* cited by examiner

SYSTEM FOR REDUCTION OF DIMENSIONAL END-TAPER IN ABRASIVE BLASTED TUBES

TECHNICAL FIELD

The present disclosure relates to a device which is aimed at reducing the severity of dimensional end-taper in abrasive blasted tubes.

BACKGROUND

One common requirement during the manufacturing process of metal tubes is to clean or condition the inner surface of the tubes thereby removing unwanted material and/or imperfections. One method which is most commonly used for this purpose is a method using hard abrasive particles and an air flow. The hard abrasive particles are made to flow through the tube by using high velocity air as the medium thus grinding the inner surface of the tubes and removing unwanted material wherein the inner surface will be cleaned and conditioned. This method is referred to as through-blasting method or blast-through method and is preferred for small diameter tubes. For tubes having larger inside diameter, a method referred to as lance method is used in which blasting nozzles emitting abrasive particles are mounted at the end of a lance that are then moved inside the tubes. These are only some of the many different methods used for tube conditioning and/or cleaning.

A common practice in tube conditioning and/or cleaning methods is to leave the exit end of the tube unsealed and thereby open to atmospheric pressure. Since air is a compressible mixture of gases and due to nature of its flow, the air velocity will increase as it approaches the open end of the tube. Due to this increasing air velocity, the abrasive particles which are carried along with it, will also gain velocity. As a result of the increase in velocity for the particles near the open end of the tube, the force with which the particles hit the inner surface of the tube will also be increased and thereby the amount of material removed from the inside diameter of the tube will be greater near the exit end of the tube. The removed material near the exit end will comprise both unwanted material and material from the tube, thus making the end of the tube wider than the rest of the tube body. This is often referred to as taper or end-taper or dimensional end-taper.

The problem of dimensional end-taper during tube cleaning and/or conditioning process is addressed in several ways in the industry. One method cuts off the end portion of the tube where the magnitude of end taper exceeds the dimensional tolerance allowed for the tube being manufactured. The disadvantage of this approach is that some yield loss associated with discarding that length of the tube will occur. Another method of dealing with end-taper involves utilizing consumable or wear parts attached to the end of the tube (physical extensions) which then become the region where end taper occurs due to excessive removal of material by high velocity abrasive particles. This in turn prevents the "real" end of the tube from being subjected to dimensional end-taper. The eroded physical extensions attached to the end of the tube are removed after the tube has been subjected to conditioning by abrasive blast method. The drawback of this approach of solving this problem is that the extensions need to be replaced frequently which means that there will be unwanted costs.

All of the above methods to solve the problem of dimensional end-taper have been in use for a long time, but do not yield satisfactory results. Accordingly, there exists a need for a system which efficiently and cost-effectively prevents the occurrence of dimensional end-taper when the inner surface of a metal tube is being cleaned and/or conditioned using abrasive blasting techniques.

SUMMARY OF THE DISCLOSURE

The aim of the present disclosure is to overcome or at least reduce the above mentioned problems. Therefore, the present disclosure relates to a system for reduction of dimensional end-taper in abrasive blasted tubes comprising:

- a pressurized chamber which maintains the pressure at a value which is higher than the atmospheric pressure;
- an outlet which allows gases to exit from the pressurized chamber at a controlled rate; a valve which restricts the passage of gases from the outlet;
- a seal connecting the tube and the pressurized chamber;
- a pressurized membrane through which the tube passes;
- a media outlet which allows removal of media and;
- optionally a sensing port where the pressure inside the pressurized chamber is monitored with a pressure gauge.

The system will reduce the severity of dimensional end-taper which occurs when the inside surface of a tube is conditioned and/or cleaned using an abrasive blasting technique. Furthermore, this system is adaptable to a wide range of tube sizes and also to the different techniques of abrasive blasting which can be employed for tube cleaning and/or conditioning.

Thus, it is an aspect of the present disclosure to prevent the dimensional end-taper at the exit end of the tube which is being conditioned and/or cleaned using abrasive blasting technique by placing the exit end of the tube into a pressurized chamber whereby a virtual extension is formed which will control the back pressure at the exit end of the tube. This control of the back pressure will control the velocity of the air flow which means that the abrasive particles will erode the inner walls of the tube with a reduced impact near the exit end compared to any known methods. Since the velocity of the media carrying the abrasive particles increases near the exit end of the tube which is usually kept at atmospheric pressure, the abrasive particles erode the inner walls of the tube with a higher impact near the exit end, thereby causing the internal diameter near the exit end to increase. The present invention proposed a solution to the problem of dimensional end-taper by placing the exit end of the tube into a pressurized chamber to create a virtual extension which controls the back pressure at the exit end of the tube.

Yet another aspect of the present disclosure is to have a system for efficient and cost-effective reduction of dimensional end-taper in abrasive blasted tubes wherein said tubes may be conditioned using any abrasive blasting technique including through blasting technique or lance-blasting method. Thus, the system may be combined with any of these methods.

Still another aspect of the present disclosure, is a method for reducing the dimensional end-taper in abrasive blasted tubes by using the system.

In the system, the gas is selected from air.

In the system, the media is selected from abrasive particles or abrasive granules.

In the pressurized chamber, the pressure is controlled in a manner that does not reduce the mass flow of gases and media inside the tube.

In the system, the pressurized chamber is lined with a polymer material.

The pressurized chamber is shaped as a cylinder, a sphere, or a square sectioned tube.

In the system, the sensing port is a pressure gauge, which is monitored.

In the system, the sensing port is a digital sensor, the output of which is used to control the position of the gas outlet such that the desired pressure in the pressurized chamber is controlled.

In the system, the gas outlet is restricted by a pinch valve, where the gas outlet is connected to a flexible hose and the hose is pinched to restrict the size of the opening of the outlet.

The pinch valve is arranged to clamp the outside of the hose and adjust the force of the clamp to adjust the size of the exit orifice.

The pinch valve is formed as a ball, a gate or a butterfly valve.

In the system, the exit opening of the gas outlet is restricted to the desired size by installing a reducer with an exit opening of pre-determined size.

In the system, the seal is an inflatable membrane seal which forms air-tight connection when it is inflated from outside.

In the system, the seal is a polymeric grommet with a hole sized such that the outside diameter of the tube forms a tight mechanical seal with the grommet sufficient to hold the pressure in the pressurized chamber.

In the system, the seal is an air-tight mechanical seal formed on the end face of the tube when the end of the tube is pressed against a gasket or an O-ring at the interface of the tube-end and the pressurized chamber.

In the system, the media outlet uses a ball valve for controlling the removal of media.

In the system, the media outlet uses a pinch valve for controlling the removal of media.

In the system, the media outlet uses a plunger valve for controlling the removal of media.

In the system, the media outlet discharges the used media into a container.

In the system, the media outlet discharges the used media into a vacuum line in communication with an air classifier which collects and sorts the media for recycling.

The foregoing summary, as well as the following detailed description of the embodiments, will be better understood when read in conjunction with the appended drawings. It should be understood that the embodiments depicted are not limited to the precise arrangements and instrumentalities shown.

DETAILED DESCRIPTION OF THE DRAWINGS

The present disclosure will now be described with reference to the accompanying embodiments which do not limit the scope and ambit of the disclosure. The description provided is purely by way of example and illustration. The examples used herein are intended merely to facilitate an understanding of ways in which the embodiments herein may be practiced. Accordingly, the examples should not be construed as limiting the scope of the embodiments herein.

Figure 1A:
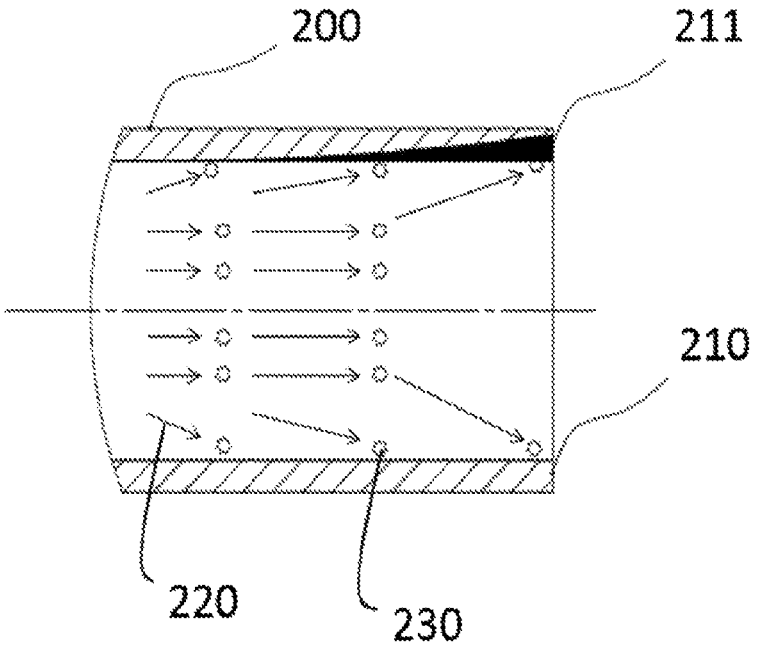
FIG. 1A illustrates the problem of dimensional end-taper when a tube is conditioned using through-blasting technique.

The present disclosure provides a solution to the above stated problem by envisaging a system for reduction of dimensional end-taper in abrasive blasted tubes, said system comprising:

- a pressurized chamber which maintains the pressure at a value which is higher than the atmospheric pressure;
- an outlet which allows gases to exit from the pressurized chamber at a controlled rate; a valve which restricts the passage of gases from the outlet;
- a seal connecting the tube and the pressurized chamber;
- a pressurized membrane through which the tube passes;
- a media outlet which allows removal of media and;
- optionally a sensing port where the pressure inside the pressurized chamber is monitored with a pressure gauge Referring to FIG. 1A, the problem of dimensional end-taper as encountered while abrasive blasting of inner surface of metal tubes is illustrated. As can be seen in FIG. 1A, the air 220 carrying abrasive particles 230 passes through the tube 200 in order to remove unwanted material from its inner surface i.e. condition or clean it. The air 220 increases its velocity as it reaches the exit end of the tube, which causes the abrasive particles to erode the exit walls of the tube with a higher impact. This causes the exit end to taper as the internal diameter of the inner surface of the tube increases, resulting in dimensional end-taper. The lower section of the tube wall 210 illustrates an idealized tube wall with no taper (uniform wall thickness). The upper section 211 represents the wall size after blasting with an open end where the shaded area represents excessive material removal as a result of blasting with an open end. The air 220 velocity is represented by the magnitude of the arrow. As the air approaches the end of the tube the velocity increases. The abrasive particle(s) 230 have a velocity in proportion to the air velocity. As the velocity increases near the exit end of the tube the particle impacts the wall with greater force and removes more material.

Figure 1B:
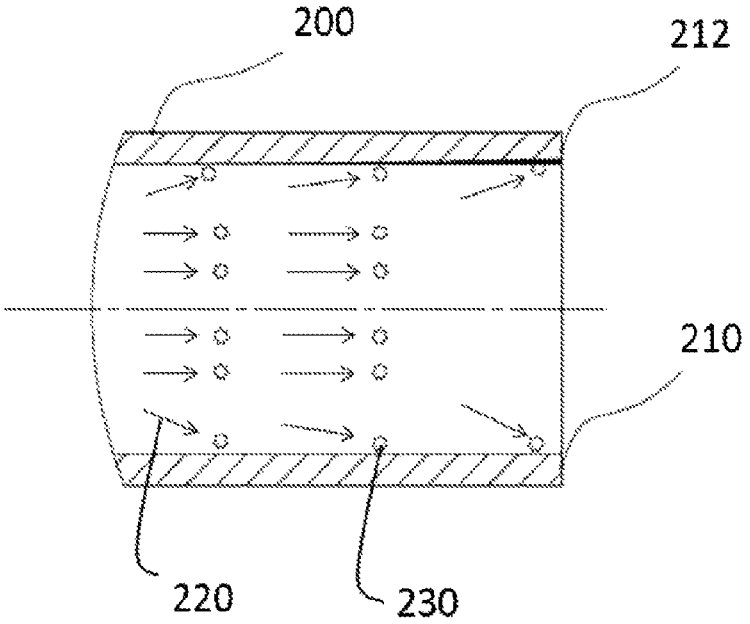
FIG. 1B illustrates the reduction in the severity of the dimensional end-taper according to one of the embodiments of the disclosure.

FIG. 1B depicts the condition of the inner surface of tube 200 when the problem of dimensional end-taper is solved according to the present disclosure by attaching the pressurized chamber next to the exit end of the tube 200. It can be observed that there is reduction in the magnitude of dimensional end-taper after the use of the pressurized chamber. The lower section of the tube wall 210 illustrates an idealized tube wall with no taper (uniform wall thickness). The upper section 212 represents the wall size after blasting with a virtual extension where the shaded area represent a reduced amount of taper compared to blasting with an open end. The air 220 velocity is represented by the magnitude of the arrow. The abrasive particle(s) 230 have a velocity in proportion to the air velocity. With the virtual extension the pressure is kept higher near the tube exit thus the air 220 velocity is kept lower preventing an increase in impact intensity near the end and reducing the magnitude of end taper.

Figure 2:
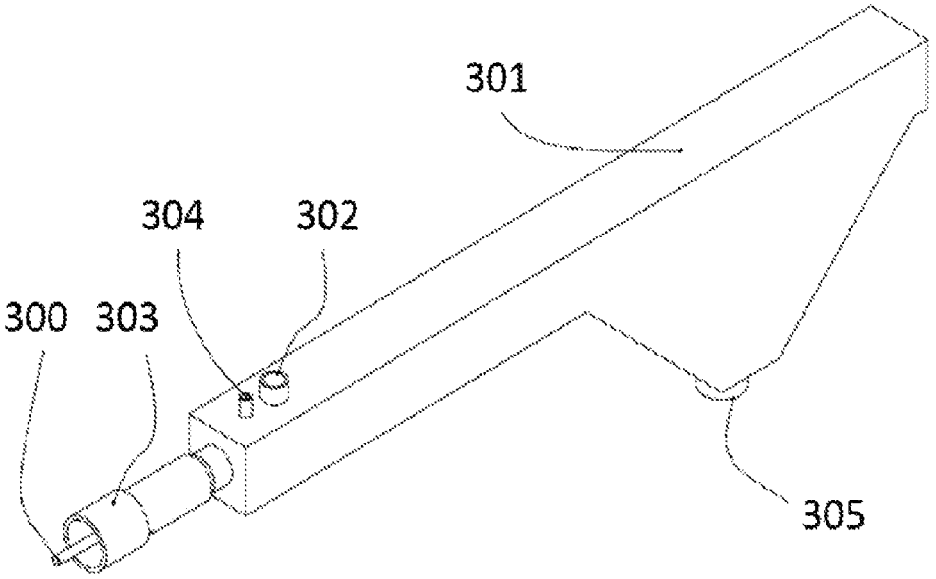
FIG. 2 illustrates a truncated view of the pressurized chamber assembly attached to the exit end of the tube according to one of the embodiments of the disclosure.

Referring to FIG. 2, a truncated view of the pressurized chamber when attached to the tube is shown. In this figure, the tube 300 can be seen entering the pressurized chamber 301 through seal 303. Also visible in the figure are media-exit port 305, air-exit port 302 and gauge port 304. According to one of the embodiments of the present disclosure, the tube 300 is installed in the abrasive blast machine with the entry end of the tube 300 in communication with the delivery of pressurized air or a combination of pressurized air and abrasive blast media. The exit end of the tube 300 is connected to the pressurized chamber 301 by means of a seal 303. The media exit 305 of the pressurized chamber 301 is closed by means of a valve. Media waste particles at the end of the conditioning process are dumped via the media exit port 305. The opening of the air-exit port 302 is regulated by means of a valve which allows the pressure inside the pressurized chamber 301 to be controlled to the desired extent. The level of pressure increase is monitored by means of a gauge installed at the gauge port 304.

Figure 3:
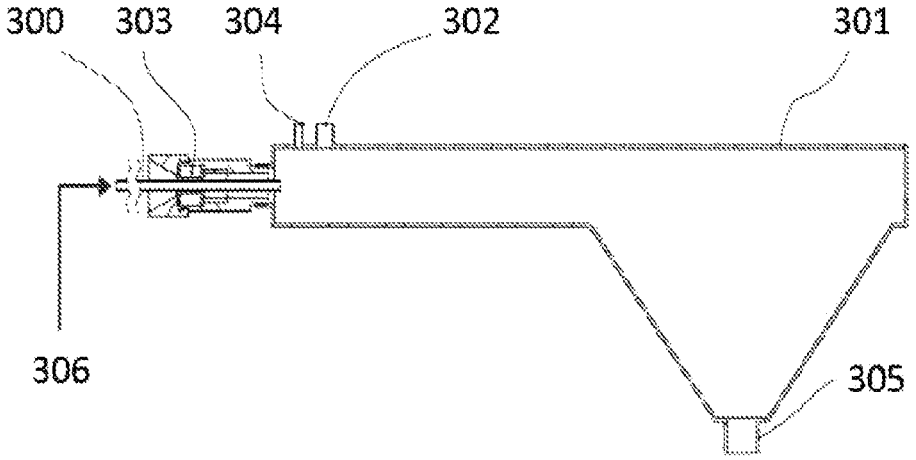
FIG. 3 illustrates a section view of the pressurized chamber according to one of the embodiments of the disclosure.

Referring to FIG. 3, a section view of the system is illustrated. According to one of the embodiments of the present disclosure, one possible configuration of the system can be seen in this figure. A virtual extension in the form of the pressurized chamber 301 controls the back pressure at the exit of the tube being blasted. The tube 300 to be blasted is connected to the pressurized chamber 301 by a seal 303. The air and blast media mixture is delivered through the tube 300 in a manner commonly known in the present art. The media exit 305 is closed and the air exit 302 is restricted such that the air pressure in the chamber 301 increases as a result of the air or air and media mixture flowing into the chamber 301 from the exit end of the tube 300. The air pressure level is monitored with a gauge installed at the gauge port 304.

According to one embodiment of the present disclosure, the seal 303 is a pressurized membrane where the seal is unpressurized and the tube 300 is inserted past the seal 303 into the chamber 301. Air pressure is then applied to the outside of the seal 303 inflating it and causing it to grip and form an air-tight seal around the tube 300. According another embodiment of the present disclosure, the seal 303 is a rubber grommet with a hole sized such that the outside diameter of the tube forms a tight mechanical seal with the grommet sufficient to hold the pressure in the chamber 301.

According to yet another embodiment of the present disclosure, an air-tight mechanical seal is formed on the end face of the tube 300 when the end of the tube is pressed against a gasket or an O-ring at the interface of the tube end and the chamber 301.

The pressurized chamber 301 is constructed to contain the air pressure (up to and including air blast pressure, typically <100 psi) and has an entry section and a tapered bottom to allow easy discharge of the used blast media. According to another embodiment of the present disclosure, the chamber 301 is lined with rubber or other polymer material to reduce the breakdown of the media and preserve the life of the chamber by minimizing wear of the wall due to media impingement on the chamber wall. The chamber 301 may also be shaped in several alternate configurations such as a cylinder, sphere, or a square sectioned tube.

According to one of the embodiments, the air exit 302 is restricted by a pinch valve where the exit is connected to a flexible hose and the hose is pinched to restrict the size of the exit orifice. The pinching is by a clamping the outside of the hose and adjusting the force of the clamp to adjust the size of the exit orifice. In another embodiment, the air exit orifice is restricted to the desired size by installing a reducer with a pre-determined size orifice (similar to a nozzle). Any number of valve configurations (ball, gate, butterfly, etc.) can be used for this purpose as long as the aperture is set to restrict the air exit sufficiently to increase the chamber pressure to the desired level.

According to one of the embodiments of the present disclosure, the pressure gauge at the gauge port 304 is a mechanical gauge and is monitored by the operator and the valve at air exit 302 is manually operated until the pressure indicated at the gauge port 304 is at the desired level. In another embodiment, the pressure gauge at the gauge port 304 is digital and the output of the pressure gauge is in communication with the control of the valve at the air exit 302 and the feedback from the pressure gauge is used to control the position of the air exit valve such that the desired pressure in the chamber 301 is controlled. In yet another embodiment, the gauge port 304 is eliminated and the restriction on the air exit 302 is determined empirically such that the resulting blasted tube 300 has exit taper reduced to an acceptable magnitude, for the product being blasted, at the end of the blast cycle.

According to yet another embodiment, the valve at the media exit port 305, is a ball valve. In an alternate embodiment, a pinch valve can also be used. In yet another embodiment, a plunger valve can be used. Also, it is possible to use any number of valve configurations (butterfly, gate etc.) as long as sufficient seal is achieved at the media exit port 305 to enable the air pressure to increase in the chamber 301 to a level which is sufficient to suppress exit taper of the tube 300.

According to another embodiment of the present disclosure, the exit port 305 discharges into a container to collect the media. In another embodiment, the exit port discharges into a vacuum line in communication with an air classifier which collects and sorts the media for recycling.

Figure 4:
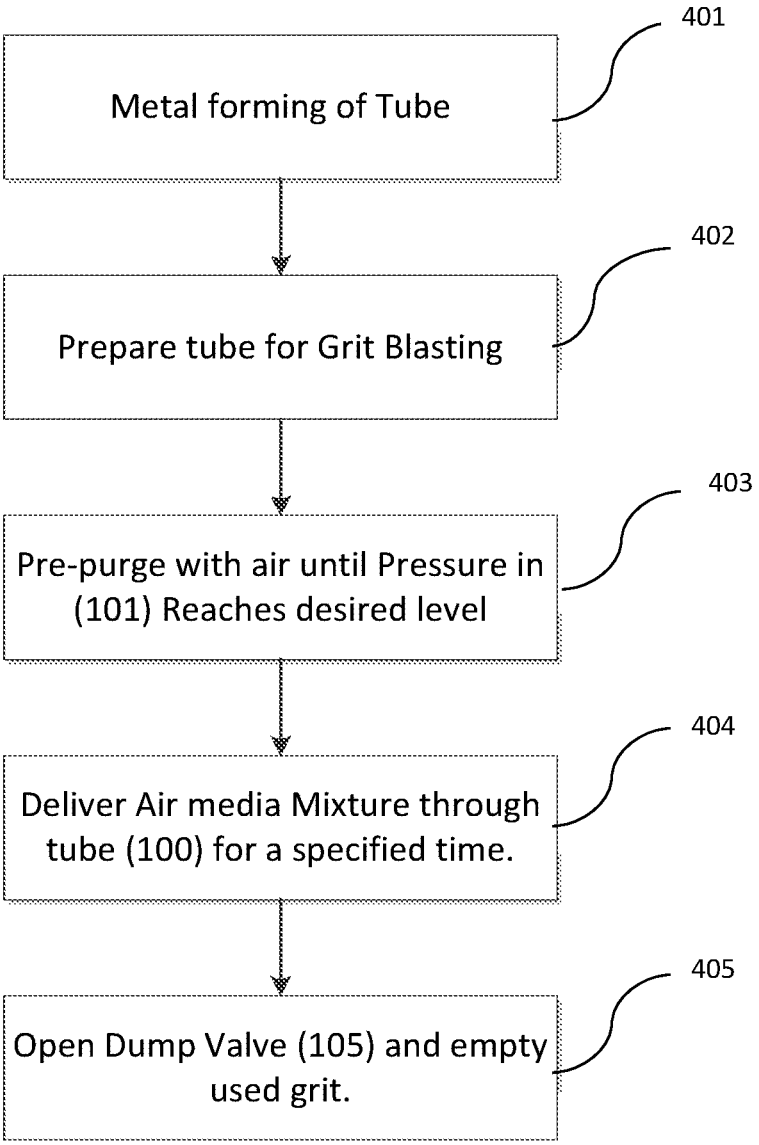
FIG. 4 shows a flow-diagram depicting steps involved in the conditioning of tubes using abrasive blasting method.

Referring to FIG. 4, the different steps in tube manufacturing process flow are depicted, with special reference to the tube conditioning process which is undertaken using abrasive blasting method. Step 401 shows that the first step in the tube manufacturing process is the metal forming of tube. The tube is metal formed close to the dimensions of the final tube on the inside diameter leaving some material to remove. This forming and/or heat-treating process generally leaves some undesirable features at or near the surface. It is beneficial to the performance of the tube to remove these undesirable features through a conditioning process such as abrasive grit blasting. Prior to grit blasting, there may be additional process steps like washing the tube to remove lubricants or other debris from previous operations. This constitutes the step 402 of the flow diagram which indicates at preparation of the tube for grit blasting. The next step 403 pre-purging the apparatus with air till a desired pressure level inside the chamber is achieved. As per this step, at the beginning of the blast cycle, only air is delivered through the tube with the exit closed and the air exit port set at an opening to cause an increase in operation pressure of the chamber. When the desired pressure is reached, the air and media combination is delivered through the tube, as per step 404. This air and media combination is delivered for a pre-determined time to achieve the desired amount of conditioning on the inside surface of the tube which occurs as a result of the action of the abrasive media on the tube inner wall. The media and air mixture delivery is then halted and the pressurized air in the chamber is allowed to escape via the air exit port. According to step 405, after the air pressure in the chamber is reduced, the media exit is opened and the used media is removed from the chamber.

According to another embodiment of the present disclosure, the air and media mixture may be delivered in the beginning of the blast cycle (chamber pressure at 0 psi gauge pressure) and the pressure in the chamber increases (due to the air component of the air and abrasive particle flow) during the first portion of the blast cycle until it reaches a steady state value determined by the air exit port valve aperture setting.

Figure 5:
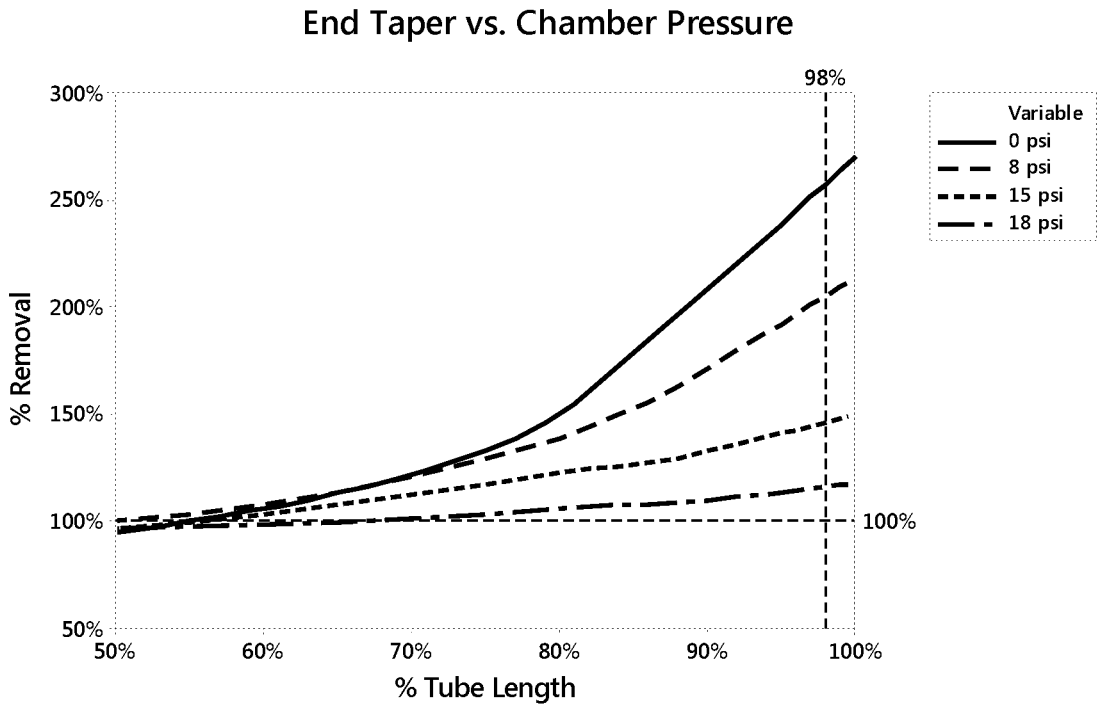
FIG. 5 shows the graphical representation of the changes in internal diameter of a tube as a result of dimensional end-taper at different pressure values near the exit end of the tube.

The system was evaluated on the basis of reduction in the material removed from the inner surface of the tube at different pressure values. The inside diameter of the tube was measured before and after blasting using an air gauge probe. The difference between the "after" dimension and the "before" dimension of the tube was calculated to determine the change of inside diameter at several locations along the length of the tube. This change in dimension is the removal. The removal amount increased at locations nearer the exit end of the tube. To illustrate the relative removal amounts, the removal amount at any given location was divided by the average removal near the center of the length of the tube. Referring to FIG. 5, the graph shows the relationship between material removal and the back pressure from the virtual extension chamber near the exit end of the tube. The graph shows the relative removals from 50% of tube length to 100% of tube length (tube exit end). When the pressure was 0 psi, the % removal at the exit end was 250%. As the pressure increased, a significant reduction in the % removal was seen at the exit end. When the pressure was 18 psi, the % removal at the exit end reduced to 120%. The tests for evaluating the present invention are also described in the examples below.

Example 1

This example illustrates the end taper occurring on through blasting of tube. A Titanium alloy tube (Ti-3Al-2.5V, ASTM Grade 9) with nominal dimensions of 0.5 in×0.026 in×200 in (Diameter×Wall×Length) was through blasted using 80 grit aluminum oxide abrasive for a fixed amount of time. The entrance end of the tube was connected to a pressure blast generator in a manner known in the art. The air and abrasive was delivered with a blast generator pressure of 50 psi air and delivered through a nozzle with a ⅜-inch orifice. The exit end of the tube was placed in a receiving chamber used to collect the used abrasive. The receiving chamber was at essentially atmospheric (room) pressure; a gauge pressure of zero (0 psi). As can be seen in FIG. 5, the graph shows the relative removals from 50% of tube length to 100% of tube length (tube exit end). For this example (0 psi) the % Removal increases from 100% near tube center to approximately 250% near tube exit. There was 2.5 times more material removed at the exit end of the tube compared to the center length of the tube.

Example 2

The conditions of Example 1 were repeated but where the exit end of the tube was placed into the virtual extension chamber 301 through a bladder seal 303. The media exit port 305 was sealed with a manual ball valve. The air exit port 302 was fitted with a pinch valve and the gauge port 304 was fitted with a Bourdon tube pressure gauge. The pinch valve orifice was adjusted such that during the blasting of the tube the pressure in the chamber 301 was 8 psi gauge pressure. The tube was blasted for a length of time to achieve essentially the same removal dimension at the center of the tube compared with Example 1. It can be seen in FIG. 5 that for this example (8 psi) the % Removal increases from 100% near tube center to approximately 200% near tube exit. There was 2 times more material removed at the exit end of the tube compared to the center length of the tube. Increasing the chamber pressure for zero to eight psi reduced the end taper from 250% to 200%.

Example 3

The conditions of Example 2 were repeated but where the pinch valve orifice was adjusted such that during the blasting of the tube the pressure in the chamber 301 was 15 psi gauge pressure. The tube was blasted for a time to achieve essentially the same removal dimension at the center of the tube compared with Example 1 and 2. For this example (15 psi) the % Removal increases from 100% near tube center to approximately 140% near tube exit. There was 1.4 times more material removed at the exit end of the tube compared to the center length of the tube. Increasing the chamber pressure from 8 to 15 psi reduced the end taper from 200% to 140%.

Example 4

The conditions of Example 2 were repeated but where the pinch valve orifice was adjusted such that during the blasting of the tube the pressure in the chamber 301 was 18 psi gauge pressure. The tube was blasted for a time to achieve essentially the same removal dimension at the center of the tube compared with Example 1, 2, and 3. For this example (18 psi) the % Removal increases from 100% near tube center to approximately 120% near tube exit. There was 1.2 times more material removed at the exit end of the tube compared to the center length of the tube. Increasing the chamber pressure from fifteen to eighteen psi reduced the end taper from 140% to 120%.

Although the present embodiment(s) has been described in relation to particular aspects thereof, many other variations and modifications and other uses will become apparent to those skilled in the art. It is preferred therefore, that the present embodiment(s) be limited not by the specific disclosure herein, but only by the appended claims.

We claim:

1. A system for reduction of dimensional end-taper in an abrasive blasted tube, said system comprising:

a pressurized chamber which maintains a pressure at a value which is higher than atmospheric pressure;

a gas outlet which allows at least one gas to exit from the pressurized chamber at a controlled rate;

a valve which restricts passage of the at least one gas from the gas outlet;

a seal connecting the tube and the pressurized chamber;

a pressurized membrane through which the tube passes;

a media outlet which allows removal of media; and optionally a sensing port where the pressure inside the pressurized chamber is monitored with a pressure gauge.

2. The system according to claim 1, wherein the at least one gas is selected from air.

3. The system according to claim 1, wherein the media is selected from abrasive particles or abrasive granules.

4. The system according to claim 1, wherein inside said pressurized chamber, the pressure is controlled in a manner that does not reduce a mass flow of the at least one gas and the media inside the tube to such an extent as to render an energy of the media ineffective as an abrasive.

5. The system according to claim 1, wherein said pressurized chamber is lined with a polymer material.

6. The system according to claim 1, wherein said pressurized chamber is shaped as a cylinder, a sphere, or a square sectioned tube.

7. The system according to claim 1, wherein said sensing port is a pressure gauge which is monitored.

8. The system according to claim 1, wherein said sensing port is a digital sensor, an output of which is used to control a position of the gas outlet such that a desired pressure in the pressurized chamber is controlled.

9. The system according to claim 1, wherein said gas outlet is restricted by a pinch valve where the gas outlet is connected to a flexible hose and the flexible hose is pinched to restrict a size of an exit opening of the gas outlet.

10. The system according to claim 9, wherein said pinch valve works by clamping an outside of the hose and adjusting a force of a clamp to adjust the size of the exit opening of said gas outlet.

11. The system according to claim 9, wherein said pinch valve is formed as a ball, a gate or a butterfly valve.

12. The system according to claim 1, wherein an exit opening of said gas outlet is restricted to a desired size by installing a reducer with an exit opening of pre-determined size.

13. The system according to claim 1, wherein said seal is an inflatable membrane seal which forms air-tight connection when it is inflated from outside.

14. The system according to claim 1, wherein said seal is a polymeric grommet with a hole sized such that an outside diameter of the tube forms a tight mechanical seal with the grommet sufficient to hold the pressure in the pressurized chamber.

15. The system according to claim 1, wherein said seal is an air-tight mechanical seal formed on an end face of the tube when an end of the tube is pressed against a gasket or an O-ring at an interface of a tube-end and the pressurized chamber.

16. The system according to claim 1, wherein said media outlet uses a ball valve for controlling the removal of media.

17. The system according to claim 1, wherein said media outlet uses a pinch valve for controlling the removal of media.

18. The system according to claim 1, wherein said media outlet uses a plunger valve for controlling the removal of media.

19. The system according to claim 1, wherein said media outlet discharges used media into a container.

20. The system according to claim 1, wherein said media outlet discharges used media into a vacuum line in communication with an air classifier which collects and sorts the media for recycling.

21. A method for reducing dimensional end-taper in an abrasive blasted tube by using the system as defined in claim 1.

* * * * *